US006286144B1

(12) United States Patent
Henderson et al.

(10) Patent No.: US 6,286,144 B1
(45) **Date of Patent: *Sep. 11, 2001**

(54) PROTECTIVE GARMENTS INCORPORATING BANDS OF WELDED OR ADHESIVELY-BONDED ELASTOMERIC MATERIAL

(75) Inventors: Christopher P. Henderson, Durham; James Fewtrell, North Rigton; Elfed I. Williams, Wales; Nicholas J. Gloag, Darlington, all of (GB)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/164,920

(22) Filed: Oct. 1, 1998

(30) Foreign Application Priority Data

Oct. 3, 1997 (GB) ..... 9720968
Mar. 6, 1998 (GB) ..... 9804692

(51) Int. Cl.[7] ..... A41B 9/00

(52) U.S. Cl. ..... 2/69; 2/457; 2/901; 2/270; 2/275; 428/152; 604/385.2

(58) Field of Search ..... 2/69, 457, 23, 2/60, 76, 82, 87, 125, 128, 171.5, 195.3, 270, 275, 901; 428/152; 604/385.2

(56) References Cited

U.S. PATENT DOCUMENTS

| | | | | |
|---|---|---|---|---|
| 4,114,200 | | 9/1978 | Smith et al. . | |
| 4,190,010 | | 2/1980 | Bibby . | |
| 4,272,851 | | 6/1981 | Goldstein . | |
| 4,407,284 | * | 10/1983 | Pieniak | 604/385.2 |
| 4,556,596 | * | 12/1985 | Meuli | 428/152 |
| 4,593,418 | | 6/1986 | Simon . | |
| 4,642,819 | * | 2/1987 | Ales et al. | 2/400 |
| 4,683,593 | | 8/1987 | Langley . | |
| 4,880,682 | * | 11/1989 | Hazelton et al. | 428/152 |
| 4,932,078 | * | 6/1990 | Jones et al. | 2/70 |
| 5,048,126 | * | 9/1991 | McLaughlin | 2/125 |
| 5,055,103 | * | 10/1991 | Nomura et al. | 604/385.2 |
| 5,501,679 | | 3/1996 | Krueger et al. . | |
| 5,509,142 | | 4/1996 | Connell et al. . | |
| 5,586,339 | | 12/1996 | Lathan . | |

FOREIGN PATENT DOCUMENTS

| | | |
|---|---|---|
| 385 466 | 11/1923 | (DE) . |
| 0 157 140 | 10/1985 | (EP) . |
| 0 233 995 B1 | 8/1990 | (EP) . |
| 2 532 337 | 3/1984 | (FR) . |
| 2199233 | 7/1988 | (GB) . |
| WO 91/07277 | 5/1991 | (WO) . |

* cited by examiner

*Primary Examiner*—John J. Calvert
*Assistant Examiner*—Robert H. Muromoto, Jr.
(74) *Attorney, Agent, or Firm*—Cecilia A. Hill; Karl G. Hanson

(57) ABSTRACT

A disposable protective garment 1 has bands 8 of elastomeric material at the wrists and/or ankles and/or around the hood 5. Each band 8 is joined to the garment by a welded or adhesively-bonded seam and extends from the garment to encircle closely the adjacent part of the body of the wearer. Each band 8 is joined in a stretched condition to the garment 1 and is then allowed to relax, thereby forming gathers 9 in the garment 1.

21 Claims, 3 Drawing Sheets

PROTECTIVE GARMENTS INCORPORATING BANDS OF WELDED OR ADHESIVELY-BONDED ELASTOMERIC MATERIAL

This application claims priority under 35 U.S.C. §119 to United Kingdom Patent Application No. 9720968.8 filed Oct. 3, 1997 and United Kingdom Patent Application No. 9804692.3 filed Mar. 6, 1998.

The present invention pertains to protective garments that are intended to be discarded when contaminated.

BACKGROUND

Protective garments are worn to protect a wearer from various hazards, including fine particles, solvents, and aggressive liquids and/or to protect a workplace, such as a clean room, from being contaminated by the person wearing the garment. Protective garments may be disposable to eliminate the need for their careful handling and expensive laundering. Disposable protective garments generally have a short service life but have the benefit of being discardable when the service life has expired. Examples of disposable protective garments are described, for example, in U.S. Pat. Nos. 4,272,851, 4,683,593, and 5,509,142.

The protection offered by a disposable protective garment is determined to a large extent by the barrier material(s) from which the garment is formed. Even when appropriate barrier materials are used, however, hazardous dusts and vapours can sometimes leak into a garment at various locations, including seams, wrist and ankle openings, and zip closures. For this reason, the number of potential leakage points is preferably kept to a minimum, and those locations are constructed to minimize leakage as best possible. Garment cost is also an important consideration when fashioning a disposable protective garment. Costs should also be held to a minimum—but consistent with the degree of protection required—to discourage continued garment use after the service life has expired.

U.S. Pat. Nos. 4,190,010, 4,593,418, and 4,683,593 describe methods of constructing seams in protective garments to reduce leakage. In the case of openings at the wrists and ankles, it is known to gather the garment using a sewn-in elastomeric material so that the garment fits more closely to the wearer's limbs at those locations. Leakage nevertheless remains a problem in those areas because of the stitching, and wearers therefore commonly apply tape there to cover the stitch holes and to further seal the garment to their bodies or to their gloves and boots. To protect zip closures, cover flaps typically are used to secure the garment on one side of the closure and, when the garment is in use, is located over the zipper and secured along the other side by an adhesive tape.

SUMMARY OF THE INVENTION

The present invention is concerned with reducing dust and vapour leakage through protective garments to increase wearer protection while avoiding substantial increases in garment cost.

In brief summary, the present invention provides, in a first aspect, a protective garment that comprises:

(a) a barrier material configured to fit on a wearer and having at least one opening disposed therein to allow an extremity of the wearer to pass therethrough; and (b) a band of elastomeric material that is joined to the barrier material at the opening(s) by at least one welded or adhesively-bonded seam, the elastomeric material being joined in a stretched condition to the barrier material and being allowed to relax to form gathers in the garment around the opening.

In this aspect, the invention overcomes the disadvantages of known protective garments that have the elastomeric material secured to the barrier material by stitching the two together. Because the invention uses a weld or an adhesive attachment, there is no opportunity for contaminants to pass through the garment's stitch holes. The invention thus eliminates the need for wearers to tape the cuffs to prevent contaminant passage through the stitch openings.

In a second aspect, the present invention provides a protective garment that comprises:

a) a barrier material configured to fit on a wearer and having at least one opening disposed therein to allow an extremity of the wearer to pass therethrough; and (b) a band of elastomeric material that is joined to the barrier material at the opening(s) by at least one welded or adhesively-bonded seam, the elastomeric material comprising a microtextured surface in at least that part of the band that would face the wearer when the garment is worn.

In this second aspect, the invention is advantageous in that a good, comfortable fit is achieved between the wearer's body and the garment. The microtextured elastomeric band is capable of easily fitting body extremities of various sizes. Microtextured materials also can be comfortably disposed on the wearer's skin.

The present invention also provides a method of forming a band around at least one opening in a protective garment, the method comprising the steps of:

joining a length of stretched elastomeric material to the garment by at least one welded or adhesively-bonded seam, and then allowing the elastomeric material to relax such that the garment forms into gathers at the seam and the elastomeric material extends from the garment; and joining the ends of the length of elastomeric material to form the said band.

The band of elastomeric material may be located at the end of a sleeve, or at the end of a trouser leg, or around a hood. The method is advantageous because it offers a simple way of finishing the openings of a protective garment providing, in comparison to conventional stitched bands, an equally good fit to the wearer and an enhanced degree of protection without the need for complex seam constructions.

BRIEF DESCRIPTION OF DRAWINGS

By way of example only, a protective garment in accordance with the present invention is described with reference to the accompanying drawings, in which.

DETAILED DESCRIPTION OP PREFERRED EMBODIMENTS

Figure 1:
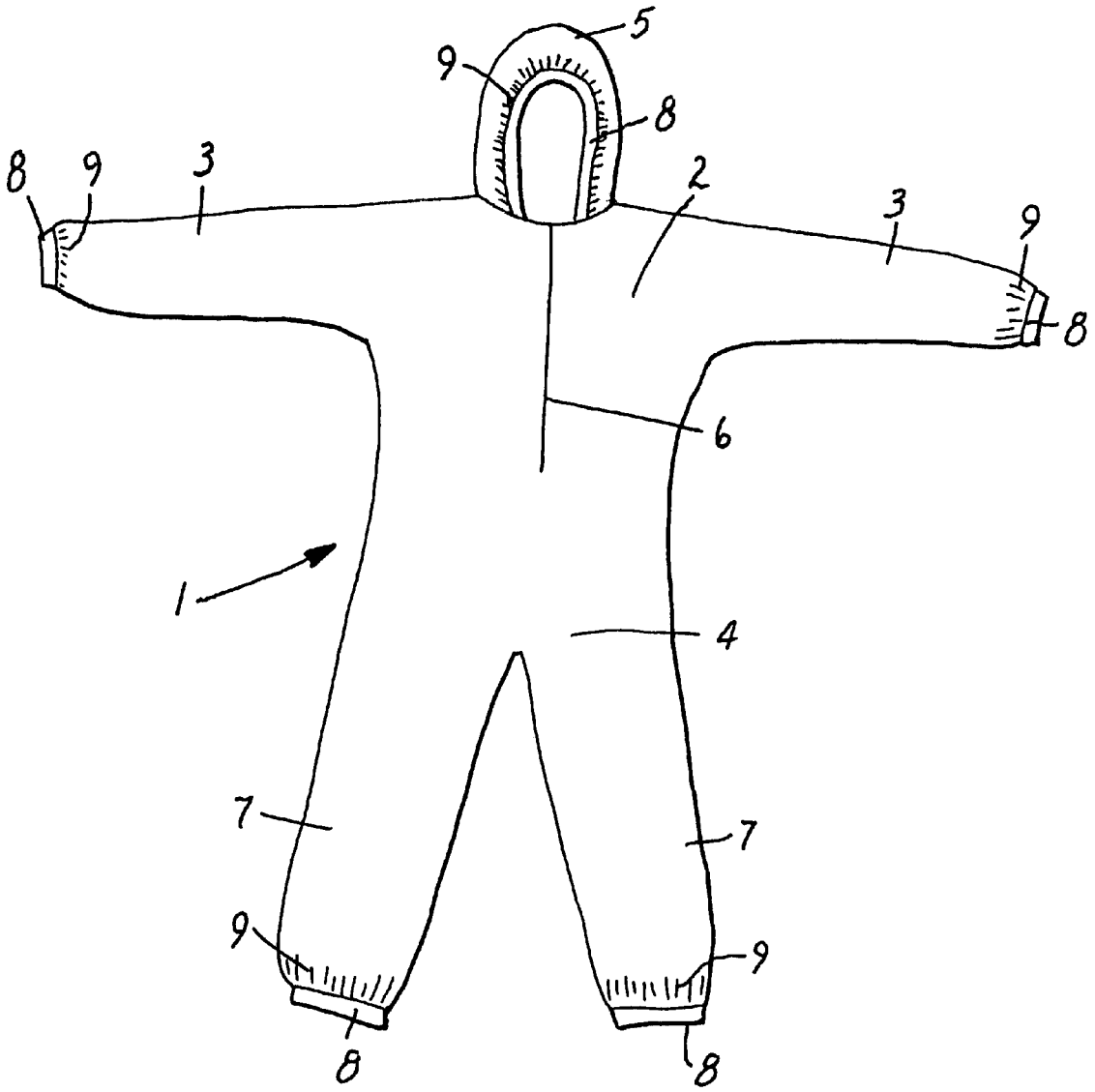
FIG. 1 is a diagrammatic front view of a protective suit in accordance with invention.

FIG. 1 illustrates, diagrammatically, a one-piece protective suit 1 having an upper body portion 2 with sleeves 3, a trouser portion 4, and a hood 5. The suit has a front access opening, indicated diagrammatically by the central line 6.

The suit may be formed from any suitable barrier material (s), selected with consideration to the substances from which protection is required. The suit may be formed, for example, from a closed plastic film(s) (generally polyolefin films), and laminates thereof, conventionally employed for protecting disposable clothing. Examples of such materials include Tyvek C™ and Tyvek F™ from E. I. DuPont de Nemours and Co. of Wilmington, Del. Alternatively, the suit may be formed from one of the microporous plastic films and non-woven laminates conventionally used to protect disposable clothing. Examples of suitable microporous plastic films include Tyvek Protech™, from E. I. DuPont de Nemours and Micropore™ from Minnesota Mining and Manufacturing Company of St. Paul, Minn. Suitable non-woven laminates are typically tri-laminates comprising two outer layers of spunbond material and an inner layer of melt blown material (so-called SMS materials). Examples of suitable non-woven laminates include Securon™, from BBA Fiberweb of Simpsonville, S.C., and MD3005, from BBA Corovin of Peine, Germany. As a further alternative, the suit may be formed from a combination of two or more of any of those materials as described, for example, in co-pending U.S. application Ser. No. 09/098,101 entitled "Protective Garments" filed on Jun. 16, 1998.

At the wrist, ankle, and face openings in the suit 1—that is, at the openings at the ends of the sleeves 3, the trouser legs 7, and in the hood 5—the suit material is gathered into bands 8 of an elastomeric material. Each of the bands 8 extends from the suit as described in greater detail below and, when the suit is being worn, will closely encircle the part or extremity of the wearer's body that extends through the opening, such as the wrist, ankle, neck, or face, as the case may be, and form a seal either against the wearer's skin or against some intervening item of clothing, for example a boot or a glove. The gathers in the suit material are indicated by reference numeral 9.

Each of the bands 8 is attached to the suit 1 by a welded or adhesively-bonded seam (not visible in FIG. 1) in a manner described below in greater detail. The bands 8, therefore, are formed from an elastomeric material that allows a weld and/or an adhesive bond (as the case may be) to be formed to the suit's barrier material. To enable the band 8 to fit closely to the wearer's body but permit the easy passage of, say, a gloved hand or a boot, the elastomeric material preferably is capable of being stretched elastically at least 150%. The bands desirably are comfortable to the wearer, and therefore are preferably formed from a material that has a soft feel and does not exert too much pressure on the wearer's skin. Preferred materials for the bands 8 are film-like elastomeric materials (typically having a thickness in the range of from 0.1 to 1 mm, more typically 0.2 to 0.4 mm) that have a microtextured surface at least on the side that faces or contacts the wearer's body. See, for example, PCT International Publication WO-A-91/07277, which claims priority to a U.S. patent application that issued as U.S. Pat. No. 5,501,679.

Suitable elastomeric materials for bands 8 are laminate materials as described in WO-A-91/07277 and U.S. Pat. No. 5,501,679 which comprise at least one elastomeric layer and at least one microtextured layer. Elastomeric materials of this type offer the advantageous possibility of being formed into bands that exhibit a substantially flat stress/strain curve over the extension range encountered during normal suit use. These bands can offer the same degree of comfort for most wearers, regardless of size. International Publication WO-A-91/07277 and U.S. Pat. No. 5,501,679 disclose non-tacky, microtextured, multi-layer elastomeric laminates. The laminates comprise both an elastomeric polymeric core layer(s), which provides elastomeric properties to the lamninate, and one or more polymeric skin layers that are capable of becoming microtextured. The micro-texturing increases the comfort level of the elastomeric material and is complemented by a significant lowering of the laminate's coefficient of friction and modulus.

In preferred embodiments of the product described in WO-A-91/07277 and U.S. Pat. No. 5,501,679, the skin layer further can function to permit controlled release or recovery of the stretched elastomer, to modify the modulus of elasticity of the elastomeric laminate, and/or to stabilize the shape of the elastomeric laminate (i.e., by controlling further necking). The laminates can be prepared by coextruding the selected polymers or by applying one or more elastomer layers onto one or more already formed skin layer(s). The novel non-tacky microtextured laminate is obtained by stretching the laminate past the elastic limit of the outer skin layers. The laminate then recovers, which can be instantaneous, over an extended time period, which is skin layer controllable, or by the application of heat, which is also skin layer controllable. The skin layer is stretched beyond its elastic limit and is relaxed with the core so as to form a microtextured surface. "Microtextured" means that the surface contains peak and valley irregularities or folds that are large enough to be perceived by the unaided human eye as causing increased opacity over the opacity of the laminate before microtexturing, and which irregularities are small enough to be perceived as smooth or soft to human skin.

The skin layer can be formed of any semi-crystalline or amorphous polymer that is less elastic than the core layer(s) and will undergo permanent deformation at the stretch percentage that the elastomeric laminate will undergo. Therefore, slightly elastic compounds, such as some olefinic elastomers, e.g., ethylene-propylene elastomers or ethylene-propylene-diene terpolymer elastomers or ethylenic copolymers, e-g., ethylene vinyl acetate, can be used as skin layers, either alone or in blends. The skin layer, however, is generally a polyolefin such as polyethylene, polypropylene, polybutylene or a polyethylene-polypropylene copolymer, but may also be wholly or partly polyamide such as nylon, polyester such as polyethylene terephthalate, polyvinylidene fluoride, polyacrylate such as poly(methyl methacrylate) (only in blends) and the like, and blends thereof The skin layer material can be influenced by the type of elastomer selected. If the elastomeric layer is in direct contact with the skin layer, the skin layer should have sufficient adhesion to the elastomeric core layer such that it will not readily delaminate. Skin-to-core contact has been found to follow three modes: first, full contact between the core and microtextured skin (FIG. 22); second, cohesive failure of the core under the microtexture folds (FIG. 23); and third, adhesive failure of the skin to the core under the microtexture folds with intermittent skin/core contact at the fold valleys (FIG. 24). Where a high modulus elastomeric layer is used with a softer polymer skin layer, however, attachment may be acceptable yet a microtextured surface may not form.

The skin layer is used in conjunction with an elastomeric layer and can either be an outer layer or an inner layer (e.g., sandwiched between two elastomeric layers). Used as either an outer or inner layer, the skin layer will modify the elastic properties of the elastomeric laminate.

The elastomer can broadly include any material that is capable of being formed into a thin film layer and exhibits elastomeric properties at ambient conditions. Elastomeric means that the material will substantially resume its original shape after being stretched. Further, preferably, the elastomer will sustain only small permanent set following deformation and relaxation which set is preferably less than 20 percent and more preferably less than 10 percent of the original length at moderate elongation, e.g., about 400–500%. Generally any elastomer is acceptable which is capable of being stretched to a degree that causes relatively consistent permanent deformation in a relatively inelastic skin layer. This may be as low as 50% elongation. Preferably, the elastomer is capable of undergoing up to 300 to 1200% elongation at room temperature, and most preferably up to 600 to 800% elongation at room temperature. The elastomer can be both pure elastomers and blends with an elastomeric phase or content that will still exhibit substantial elastomeric properties at room temperature.

Preferably, the elastomeric material used for the bands 8 is a three-layer laminate comprising two outer microtextured layers sandwiching a core elastomeric layer. When the suit material comprises a polyolefin material, the microtextured layers are preferably also formed from a similar polyolefin material, typically polypropylene. Some other suitable elastomeric materials for the bands 8 include Kraton™ rubber from Shell Chemical Company, Beaupre, Ohio. The width of the material 10 is preferably such that the resulting band 8 has a width of at least 8 mm.

Although FIG. 1 shows a protective suit having bands 8 of the type described above at the wrists, ankles, and also around the hood, it is possible for the bands to be provided in just one or two of those locations. Bands of that same type also could be used on a protective jacket (with or without a hood) and on protective trousers. The bands 8 are formed by attaching the elastomeric material in a stretched condition to the suit material and then allowing it to relax, thereby forming gathers in the suit material.

Figure 2:
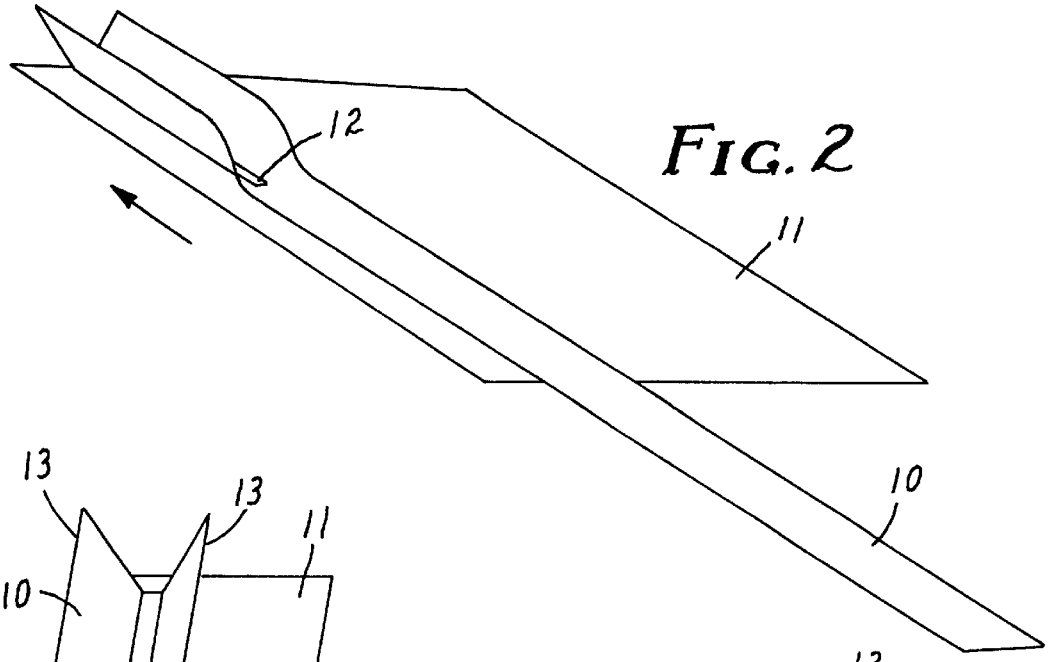
FIG. 2 illustrates the method of forming a part of the suit shown in FIG. 1.

As shown in FIG. 2, this can be accomplished where a length of the elastomeric material 10 in stretched condition is attached to a patch of the suit material 11, which is unstretched and, at this stage, flat, and ungathered.

In the case where the elastomeric material is to be welded to the suit material 11, the suit material 11 and the stretched elastomeric material 10 are fed, either by hand or mechanically, to the nip (not shown) of an ultrasonic rotary welder or, alternatively, are located under a static plunge welder (both forms of welder being well known). The welder forms a continuous seam 12 between the two materials, following which the elastomeric material 10 is allowed to relax and form gathers in the suit material 11 adjacent the seam. Because of the presence of the seam 12, the degree of relaxation in the elastomeric material is not uniform across the width of the material 10 but increases in the direction away from the seam 12 and, as a result, the material 10 is pulled into a circle. The ends of the elastomeric material 10 are then joined to form a band 8.

In the alternative case in which the elastomeric material 10 is adhesively-bonded to the suit material 11, an adhesive line is applied to the suit material at the desired seam line, and the stretched elastomeric material is fed onto that either by hand or mechanically. The adhesive also forms a continuous seam 12 between the two materials, following which the elastomeric material 10 is allowed to relax and form gathers in the suit material 11. The adhesive selected to join the materials 10, 11 depends on the nature of those materials and may be, for example, a hot melt adhesive applied at an appropriate temperature either by hand or from a coating head. In the case in which the adjacent bonded surfaces comprise similar polyolefin materials, typically polypropylene, the adhesive employed may be an amorphous polyolefin-based hot melt adhesive or an EVA-based hot-melt adhesive. Suitable adhesives include Jet Melt 3762 LM™, Jet Melt 3792LM™, Jet Melt 3748™ and Spray Bond 6111™, all available from the Minnesota Mining and Manufacturing Company of St. Paul, Minn.

Figure 3:
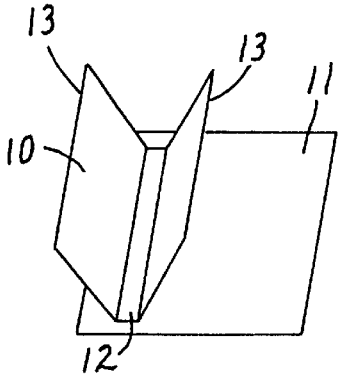
FIG. 3 is a diagram illustrating one possible construction of that part of the suit.

The final form of the band 8 can be varied by changing the seam location across the width of the length of material 10. FIGS. 2 and 3, for example, show the seam 12 being formed along the longitudinal center line of the elastomeric material 10. In this case, the length of elastomeric material 10 tends to fold up about the seam 12 and, when it is allowed to relax after welding, the two longitudinal edges 13 of the material will come together so that the resulting band 8 will comprise two thicknesses of material.

Figure 4:
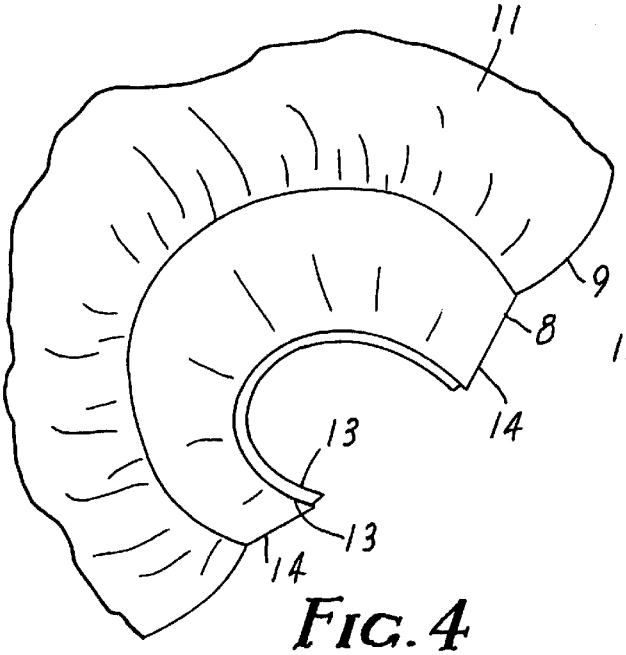
FIG. 4 is a perspective view of that part of the suit prior to completion.

FIG. 4 shows such a band 8 attached to the suit material 11, but before the ends 14 of the band have been joined together. When the garment is in use, the outer edge portion (at least) of the double thickness band 8 will fit closely around, and seal against, the adjacent part of the body of the wearer.

Figure 5:
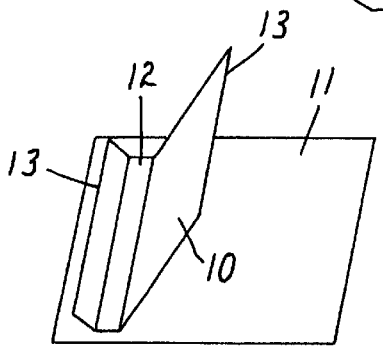
FIGS. 5 and 6 are similar to FIG. 3 but illustrate alternative constructions for that part of the suit.

FIG. 5 is similar to FIG. 3 but shows the seam 12 being formed close to one of the longitudinal edges 13 of the length of material 10. In this case, the material 10 will again tend to fold up about the seam 12 and form into a circle when it is allowed to relax but the resulting band will comprise only one thickness of material and, for a given width of material 10, will be wider than the band 8 of FIG. 4. When the garment is in use the outer edge portion (at least) of the single thickness band will fit closely around, and seal against, the adjacent part of the body of the wearer.

Figure 6:
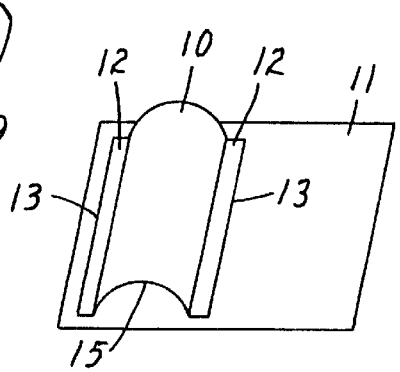

FIG. 6 shows two seams 12, each located along a respective one of the longitudinal edges of the material 10. In this embodiment, the material 10, when allowed to relax, will tend to pull up between the seams 12 to form a curve 15 across the width of the material as well as forming into a circle along its length. When the garment is in use, the band of material 10 is located on the inside of the garment and, because of the curved shape between the seams 12, stands up from the garment to fit closely around, and seal against, the adjacent part of the body of the wearer.

Figure 7:
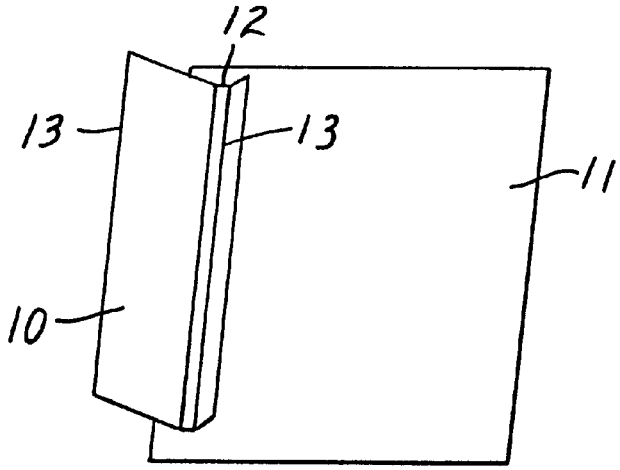
FIGS. 7 and 8 are similar, respectively to FIGS. 5 and 4, but illustrate yet another alternative construction for that part of the suit.
Figure 8:
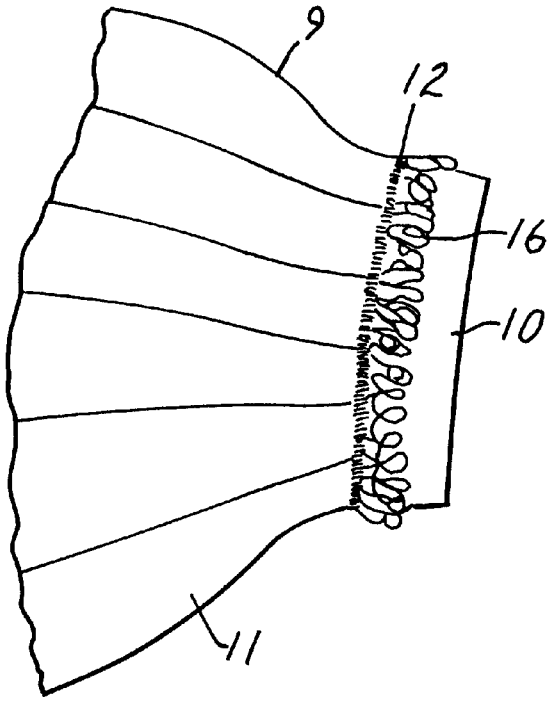

FIG. 7 shows the seam 12 being formed closer to the other longitudinal edge 13 of the length of material 10. In this embodiment, when the material 10 is allowed to relax, the gathered free end 16 of the suit material 11 remains visible on the outside of the suit as shown in FIG. 8.

The bands 8 formed as described above will seal against the skin of the wearer, or against an intervening item of clothing and inhibit the leakage of dust and vapours into the protective garment at those locations. The absence of any stitch holes in the seam between the bands and the garment is also of assistance in reducing leakages of dust and vapours into the garment. The bands are comparatively simple to attach and do not increase the complexity and manufacturing costs of the garment but nevertheless offer increased comfort over conventional elasticated cuffs.

The total content of all patents and patent applications cited above are incorporated by reference into this document.

The present invention may be suitably practiced in the absence of any feature not specifically described in this document.

Although preferred embodiments have been described in detail, the invention is not limited to such but is governed by the limitations set forth in the following claims and equivalents thereof Various alterations may be made to the invention described without departing from its spirit and scope.

We claim:

1. A protective garment that comprises:

(a) a barrier material configured to fit on a wearer and having at least one opening), disposed therein to allow an extremity of the wearer to pass therethrough; and (b) a band of elastomeric material at the opening to encircle closely the extremity of the wearer when the garment is being worn;

wherein:

(c) the band comprises a piece of elastomeric sheet material, having length, and width, joined to the barrier material at the opening by at least one welded or adhesively-bonded continuous seam extending along the length of the piece of elastomeric material;

(d) the piece of elastomeric material is joined in a stretched condition to the barrier material and allowed to relax to form gathers in the barrier material around the opening; and (e) the width of the piece of elastomeric material is substantially greater than the width of the seam whereby part of the width of the elastomeric material remains unattached and extend,; from the barrier material to form a seal around the extremity of the wearer when the garment is; being worn.

2. The protective garment of claim 1, in which the elastomeric material has a microtextured surface in at least that part of the band facing the body of the wearer.

3. The protective garment of claim 1, in which the piece of elastomeric material is a least 8 mm wide.

4. The protective garment of claim 1, in which the elastomeric material can be stretched elastically by at least 150%.

5. The protective garment of claim 1, in which the elastomeric material has a substantially flat stress/strain curve over the extension range encountered by the band during normal use of the garment.

6. The protective garment of claim 1, in which the elastomeric material is a film material having a thickness in the range of from 0.1 to 1 mm.

7. The protective garment of claim 1, in which the elastomeric material is a laminate comprising at least one elastomeric layer and at least one microtextured skin layer.

8. The protective garment of claim 1, in which the elastomeric; material is joined to the barrier material by a seam extending along a longitudinal center line of the elastomeric material such that both halves of the piece of elastomeric material on each side of the center line extend from the barrier material to form a seal around the extremity of the wearer when the garment is being worn.

9. The protective garment of claim 1, in which the elastomeric material is joined to the barrier material by a seam extending along the length of the elastomeric material and located towards one side thereof such that substantially the whole width of the piece of elastomeric material extends from the barrier material to form a seal around the extremity of the wearer when the garment is being worn.

10. The protective garment of claim 1, in which the elastomeric material is joined to the barrier material by two seams extending along the length of the elastomeric material and each located towards a respective side thereof such that the elastomeric material between the seams curves upwardly away from the barrier material to form a seal around the extremity of the wearer when the garment is being worn.

11. The protective garment of claim 1, in which the barrier material is fluid-impermeable.

12. The protective garment of claim 1, in which the elastomeric material and the barrier material to which the band is joined both comprise a polyolefin material.

13. The protective garment of claim 1, in which the seam is an adhesively-bonded seam, formed using a hot melt adhesive.

14. The protective garment of claim 1, in which the seam is an adhesively-bonded seam that is bonded using an adhesive that is an amorphous polyolefin-based adhesive or an EVA-based adhesive.

15. The protective garment of claim 1, in which the elastomeric material is a laminate comprising at least one elastomeric layer and at least one microtextured skin layer.

16. A body suit that comprises the protective garment of claim 1.

17. The protective garment of claim 1 including one or more of the following parts: a hood, sleeves, and pants.

18. A method of forming a band around at least one opening in a protective garment, the method comprising the steps of:

providing a piece of elastomeric sheet material having length and width;

joining the piece of elastomeric material to the protective garment at the opening by at least one welded or adhesively-bonded continuous seam extending along the length of the piece of elastomeric material; and joining the ends of the length of elastomeric material to form the band;

wherein:

the elastomeric material is joined in a stretched condition to the barrier material and allowed to relax to form gathers in the barrier material around the opening; and the width of the piece of elastomeric material is substantially greater than the width of the seam whereby part of the width of the elastomeric material remains unattached and extends from the barrier material to form a seal around the extremity of the wearer when the garment is being worn.

19. The method of claim 18, in which the elastomeric material and the part of the barrier material to which the band is joined both comprise a polyolefin material.

20. The method of claim 18, in which the seam is an adhesively-bonded seam, formed using a hot melt adhesive.

21. A protective garment that comprises:

(a) a barrier material configured to fit on a wearer and provide a hood with openings for the wearer's face and neck; and (b) a band of elastomeric material at a said opening to encircle closely the face or neck of the wearer when the garment is being worn; wherein:

the band comprises a piece of elastomeric sheet material, having length and width, joined to the barrier material at the opening by at least one welded or adhesively-bonded continuous seam extending along the length of the piece of elastomeric material;

the piece of elastomeric material is joined in a stretched condition to the barrier material and allowed to relax to form gathers in the barrier material around the opening; and the width of the piece of elastomeric material is substantially greater than the width of the seam whereby part of the width of the elastomeric material remains unattached and extends from the barrier material to form a seal around the face or neck of the wearer when the garment is being) worn.

* * * * *

UNITED STATES PATENT AND TRADEMARK OFFICE

CERTIFICATE OF CORRECTION

PATENT NO. : 6,286,144 B1
DATED : September 11, 2001
INVENTOR(S) : Henderson et al.

It is certified that error appears in the above-identified patent and that said Letters Patent is hereby corrected as shown below:

Column 2,
Line 51, after "with" insert -- the --.

Column 6,
Line 60, after "opening)," should read as -- opening --.

Column 7,
Line 11, "extend,;" should read as -- extend --.
Line 13, "is;" should read as -- is --.
Line 33, "elastomeric;" should read as -- elastomeric --.

Column 8,
Line 58, "being)" should read -- being --.

Signed and Sealed this

Thirtieth Day of April, 2002

*Attest:*

*Attesting Officer*

JAMES E. ROGAN
*Director of the United States Patent and Trademark Office*